US005406058A

United States Patent [19]

Lipp

[11] Patent Number: 5,406,058

[45] Date of Patent: Apr. 11, 1995

[54] APPARATUS FOR DRYING CERAMIC STRUCTURES USING DIELECTRIC ENERGY

[75] Inventor: G. Daniel Lipp, Big Flats, N.Y.

[73] Assignee: Corning Incorporated, Corning, N.Y.

[21] Appl. No.: 159,678

[22] Filed: Nov. 30, 1993

[51] Int. Cl.[6] ..... H05B 6/60

[52] U.S. Cl. ..... 219/774; 219/775; 432/258; 264/25; 264/57; 34/255

[58] Field of Search ..... 219/775, 774, 776, 762; 432/258, 259; 264/25, 26, 27, 57, 58; 34/1 A, 1 E, 1 K, 1 X, 250, 255

[56] References Cited

U.S. PATENT DOCUMENTS

| | | | |
|---|---|---|---|
| 2,866,063 | 12/1958 | Rudd | 219/774 |
| 2,867,888 | 1/1959 | Schaefer et al. . | |
| 3,284,917 | 11/1966 | Foote | 34/21 |
| 3,352,951 | 11/1967 | Sara . | |
| 3,859,493 | 1/1975 | Peterson | 219/762 |
| 4,014,968 | 3/1977 | Simon . | |
| 4,184,840 | 1/1980 | Gamberg et al. . | |
| 4,259,061 | 3/1981 | Dubetsky . | |
| 4,405,300 | 9/1983 | Lubowsky et al. . | |
| 4,693,918 | 9/1987 | Fujimoto et al. . | |
| 4,715,812 | 12/1987 | Matuschka et al. . | |
| 4,837,943 | 6/1989 | Mizutani | 34/1 E |
| 5,205,991 | 4/1993 | Avery et al. | 34/10 |
| 5,263,263 | 11/1993 | Gheorghiu et al. | 34/1 K |
| 5,273,692 | 12/1993 | Numoto et al. | 264/26 |

FOREIGN PATENT DOCUMENTS

| | | | |
|---|---|---|---|
| 0234887A1 | 9/1987 | European Pat. Off. . | |
| 0449534A1 | 10/1991 | European Pat. Off. . | |
| 2216115 | 10/1989 | United Kingdom . | |
| 1268922 | 11/1986 | U.S.S.R. | 432/258 |

*Primary Examiner*—Philip H. Leung
*Attorney, Agent, or Firm*—Angela N. Nwaneri

[57] ABSTRACT

The present invention features a process and apparatus for drying ceramic structures in an electromagnetic energy field. The apparatus comprises a cradle or setter for supporting the ceramic structure which is made of a light-weight, tough, temperature-resistant material which does not absorb energy in the radio frequency range, for example, fiberglass reinforced polyester. The setter is also characterized by many apertures to allow passage of air or moisture, and is designed to avoid trapped air volumes.

17 Claims, 6 Drawing Sheets

APPARATUS FOR DRYING CERAMIC STRUCTURES USING DIELECTRIC ENERGY

BACKGROUND OF THE INVENTION

The invention relates to a method and apparatus for drying ceramic articles using dielectric energy without distortions and other surface flaws.

It has been a long standing manufacturing problem to efficiently produce ceramic structures without both structural defects and skin or surface related flaws or "fissures," which together account for a majority of all rejects in the manufacturing process. When used as a catalytic support for an automotive exhaust system, fissures provide focal points for stress and heat differentials in the ceramic support during automotive exhaust gas cycling, and eventually spread and cause failure of the catalytic support material.

Surface defects are particularly problematic in continuous extrusion processes. In a typical manufacturing process, as the wet or green log or ceramic structure leaves the extruder, it is conveyed by air bearings to a ceramic carrier or setter which is generally contoured to the shape of the log. Honeycomb extrusions of very large (up to 13.5 inch diameter) diesel particulate filters, for example, are dried initially in a dielectric oven. Each "log" or continuous extrudate rests on a horizontal position on a ceramic tray or carrier and is conveyed through the oven on a conveyor belt. The log-bearing setters or carriers are carried into a dielectric oven where the logs are dried. The dried logs are then cut and fired to form the catalyst material supports. Most surface defects occur as the setter/logs travel to and through the dielectric drier. This is because the log leaving the extruder has a high water content and evaporation from the log begins immediately upon its exit from the extruder. Generally, the drying is not uniform. For instance, the bottom of the log is much dryer than the top of the log. It is theorized that the underside of the log dries faster than the rest of the material due to its proximity to the lower electrode in the dielectric oven. Also, both the leading and trailing surfaces of the log tend to lose water very slowly, often retaining all or close to all of its original water. As a result of this uneven drying, a stress differential is created between the top and bottom surfaces of the log causing fissures to form, especially on the top surface. The fissures form to alleviate the stress created between the quicker shrinking bottom surface layer and the top layer. Because the bottom of the log dries much faster, any additional energy absorbed by the log causes it to overheat and/or burn in the driest regions. Finally, the stresses are retained in the ware and may cause cracking during the firing or sintering step.

Uneven drying in a dielectric oven is caused by variations in the energy field. Generally, the field is strongest in the regions nearest the electrodes, that is, above and below the log, and weakest at the leading and trailing regions of the log. Thus, the farther from the electrodes, the weaker the field. Also, interference from adjacent logs may contribute to the weakness of the field at the leading and trailing regions of the logs.

In the wet or green state, ceramic ware is easily distorted. This is particularly true with honeycomb structures having an intricate matrix of thin to very thin cell walls which easily slump or distort when wet. To minimize slumping and distortions, in the dielectric oven, it is often necessary to support the wet or green ceramic ware on a contoured tray or setter until the ware is sufficiently dry to maintain its shape. The problems encountered in the initial drying of ceramic ware are different and in addition to those which are later encountered when such ware are fired or sintered. Many of the setters which have been disclosed for sintering ceramic ware have been ceramic materials which in some cases have been shaped to minimize the occurrence of cracking and other problems encountered when ceramic ware is fired.

While various methods have been suggested for making setters or trays for supporting ceramic ware during the sintering or firing process, very little has been disclosed for supporting such ware in a dielectric drying environment.

A common type of tray used to support ceramic ware in the dielectric drying process is made from light weight, filled ceramic material which is either cast or machined to fit the shape of the ceramic ware. However, such ceramic trays are fragile and friable. They are easily chipped or broken in handling, producing dust particles which are irritating to the skin and throat. In addition, because the trays are fragile, they are often set in a strong plastic such as Lexan® or onto a flat plate of a glass fiber reinforced plastic. Like the ceramic trays, the Lexan® is also easily damaged in handling sometimes resulting in catastrophic failures. For example, in the event of arcing or overheating in the dielectric dryer, the Lexan® will melt, creating a major clean-up problem. As a result of these problems, ceramic trays are not cost effective. More importantly, ceramic trays absorb energy in the radio frequency range, thereby reducing the energy available for drying the ceramic ware. Also, because ceramic trays absorb dielectric energy in the radio frequency range, much of the absorbed energy is transferred by conduction to the bottom portion of the logs causing this section of the log to dry faster than the rest of the log.

Therefore, there continues to be a need for apparatus and methods for drying wet or green ceramic ware in a dielectric dryer without slumping or distorting the ceramic ware. Accordingly, it is the object of the present invention to provide a cost effective apparatus and method for supporting green ceramic ware while avoiding or significantly reducing the aforementioned problems.

SUMMARY OF THE INVENTION

Briefly, the present invention provides a method of drying wet ceramic ware in a dielectric dryer without distorting the ware by using a setter or carrier which is transparent to the energy field of the dielectric oven, or is characterized by low absorption for energy in the radio frequency range. By low absorption, I mean less than 10% absorption, preferably less than 5%. The setter or tray is so designed to achieve uniform drying by compensating for the uneven distribution of field strength in the dielectric oven.

The wet ceramic structure or object to be dried by the method and apparatus of the invention can be formed using any well-known forming methods such as injection molding, casting, extrusion or other known methods. For honeycomb structures extrusion is the preferred forming method.

After leaving a forming member such as an extrusion die, the ceramic structure or log enters a conveyor apparatus, supported on a setter which sits on the conveyor apparatus, until it reaches the dielectric dryer carrier of the invention. The carrier according to the invention, is made up of a top portion or mantle which comprises a support surface or cradle for carrying the ceramic structure. The cradle or support surface features a plurality of apertures through which air may pass to the structure. The mantle sits on a bottom portion or base which is substantially flat, and which sits on the conveyor apparatus.

As used in this specification, cellular or honeycomb structure or body includes any monolithic structure having inlet and outlet end faces, and having a matrix of walls defining a plurality of open-ended cells or passageways extending longitudinally and mutually parallel therethrough between the inlet and outlet end faces of the body.

DESCRIPTION OF THE PREFERRED EMBODIMENT

The invention provides a manufacturing system and method for fabricating ceramic structures which may be used as catalyst supports for automotive catalytic converters, as diesel particulate filters, fluid filters and other refractory applications. For these application, the ceramic structure is preferably an extruded honeycomb structure.

Examples of useful ceramic materials for forming the ceramic structures of the invention include, alumina, cordierite, and aluminum silicate (mullite). For automotive applications, cordierite is preferred because of its low thermal expansion properties. For other applications where the heating is slower and where thermal stress is not as severe, other non-conductive materials can be used such as alumina and mullite.

The ceramic structures can be processed by any of the known methods for fabricating ceramic monoliths, such as for example, by extrusion. The process may be either a batch process (as with a ram extruder), or a continuous process (as with a screw-type extruder). Regardless of the process, the batch material to be extruded is forced through the die of the extruder to form an extrudate, which in the case of a honeycomb die, is extruded in the form of a log. After leaving the extruder, the log is dried and fired using the apparatus and method of the invention.

Figure 1:
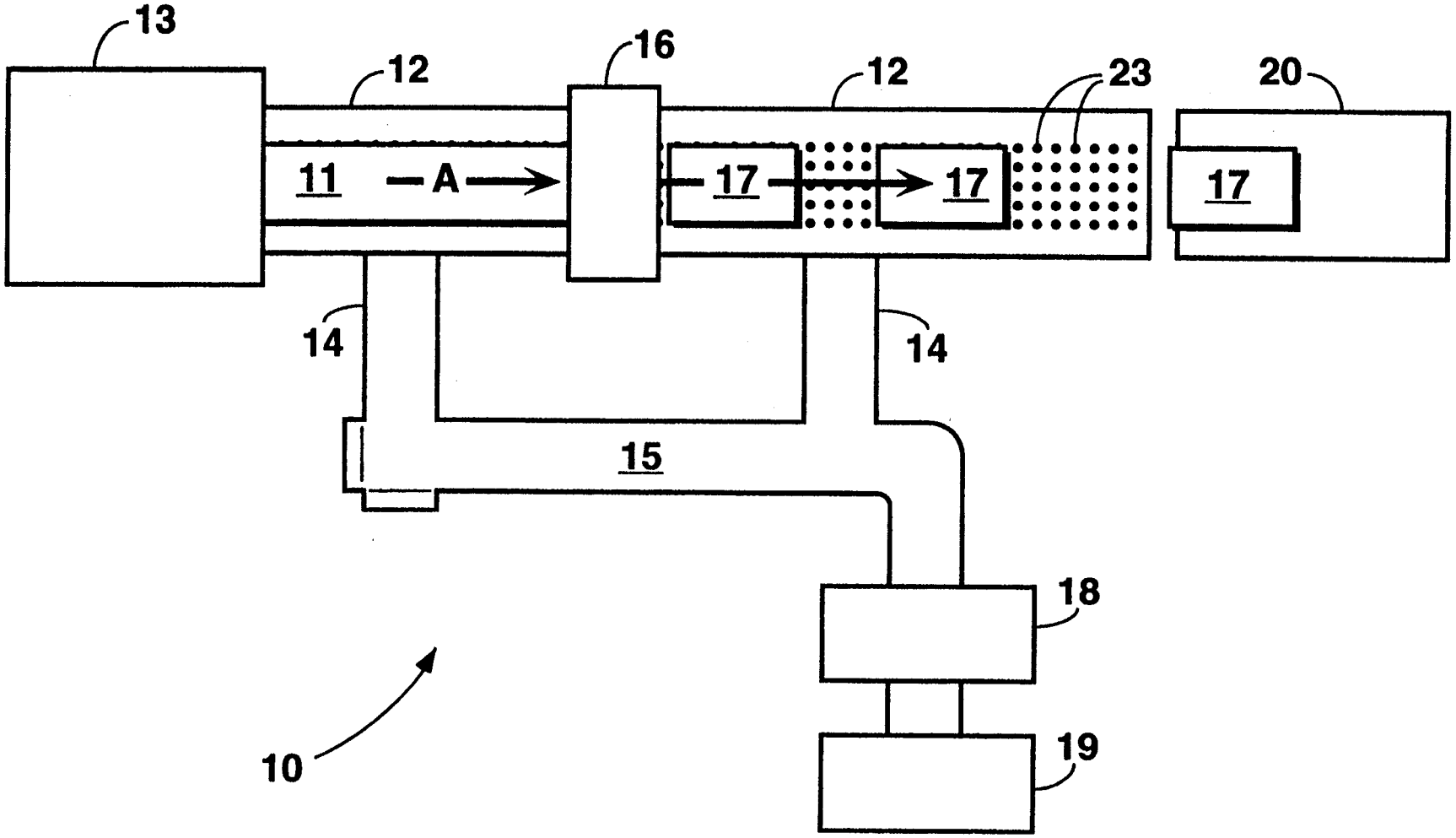
FIG. 1 depicts a top view of the gaseous fluid (air) bearing system used to convey the ceramic substrate from an extruder to a dryer carrier.

Now referring to FIG. 1, an air bearing system 10 is shown. A log 11 is directed over a guide path A (arrow) of the air bearing system 10, after having left the extruder 13. The air bearing system 10 comprises a series of air bearing support chambers 12 that are each supplied with air through individual conduits 14, each of which is connected to a common air supply pipe 15. A mechanical saw 16, whose velocity matches that of the log 11, is used to cut the log into pieces 17 of uniform length to form the desired ceramic structure or ware.

Air blowers 19 and a humidifier 18, such as Model No. CES-012AS010-483 Chromalox electric boiler manufactured by Emerson Electric Co. (Pittsburgh, Pa.) and Model No. LB-10 manufactured by Electro-Steam Generator Corp. (Alexandria, Va.), are disposed in a common air supply pipe 15 upstream of the individual conduits 14, for maintaining the proper velocity and range of relative humidity for the air being supplied to the air bearing system 10.

After leaving the extruder 13, the ceramic log 11 is supported and conveyed upon an air bearing surface to a dielectric dryer carrier or setter 20 into the dielectric environment. The dielectric environment is a high frequency energy environment created by any means such as for example, a dielectric oven capable of generating energy in the radio frequency range or between about 10 MHz and 3.0 GHz, to dry and fire the structure. Before entering the dielectric dryer, the logs 11 are cut into smaller ceramic structures or ware 17 which are then dried in the dielectric oven and eventually sintered or fired for subsequent processing or use.

The setter 20 of the invention is intended for use in the dielectric drying of the ceramic structure. Preferably, the setter 20 is high temperature resistant, and exhibits low energy absorption in the radio frequency range. By absorbing little or no energy in the radio frequency range, all or most of the energy is then available for drying the ware. One particularly useful material for the setter of the invention is fiberglass reinforced polyester. However, any high temperature resistant material which exhibits low energy absorption in the radio frequency range may be used for this purpose. By low absorption, I mean that the setter material absorbs little or no energy in the radio frequency range. In a particularly preferred embodiment, the setter absorbs less than 10 percent, more preferably, less than 5% of the energy in the field.

Figure 2:
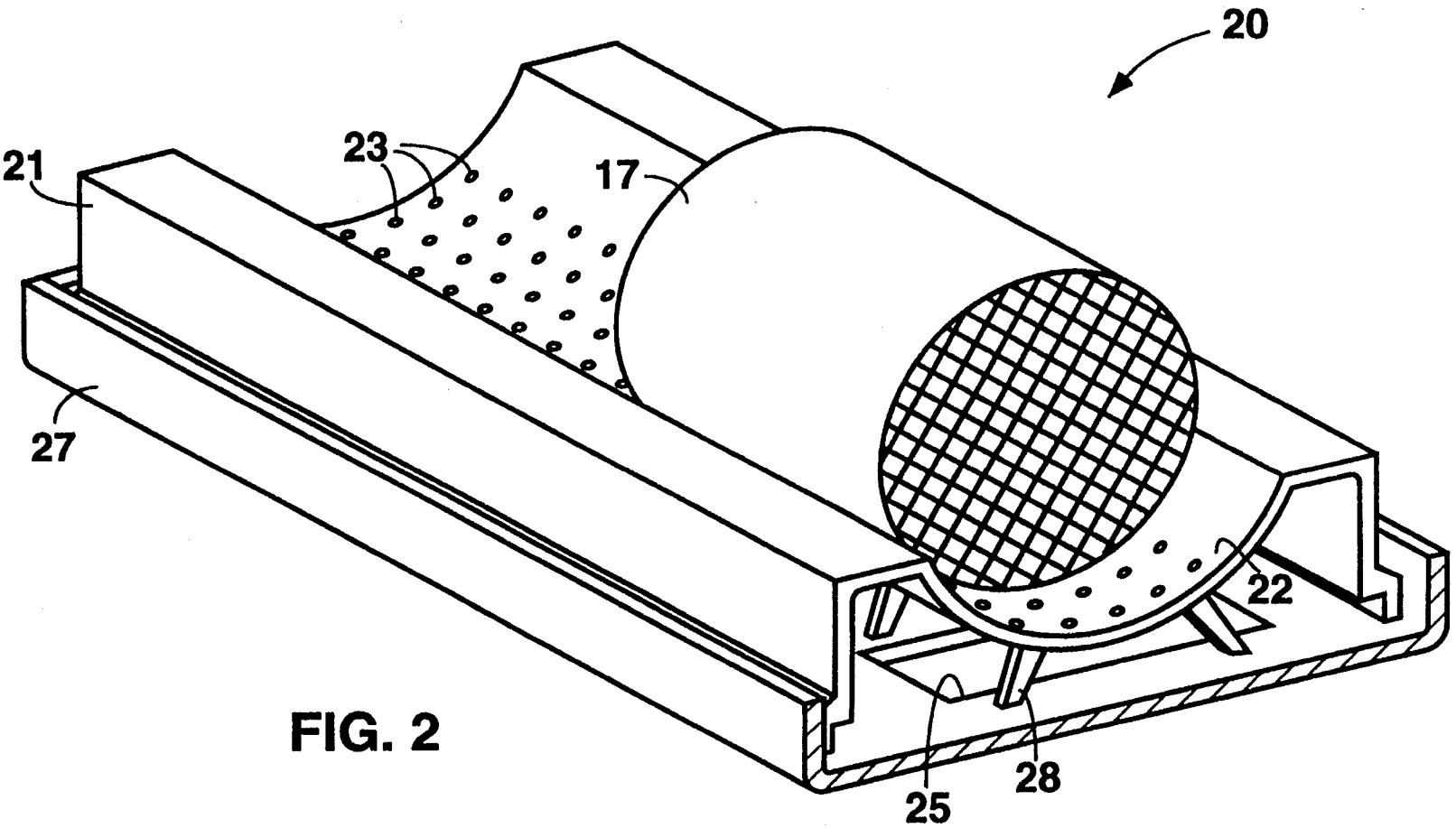
FIG. 2 illustrates a perspective view of a section of the dielectric dryer carrier or setter of the invention, depicting the apertures on the support surface or cradle overlayed or supported on a base or bottom portion.

Preferably, the setter 20 consists of two parts, a top portion or mantle which sits on a bottom portion or base as shown in FIG. 2. The mantle 21 includes a support surface or cradle 22 which is preferably contoured to fit the shape and size of the ceramic ware 17.

Figure 3B:
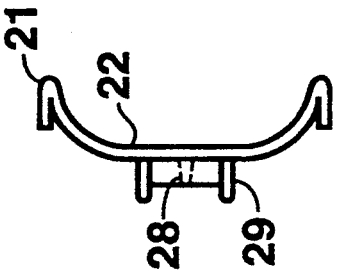
FIG. 3*b* is a side view of the mantle of FIG. 3*a;*
Figure 3A:
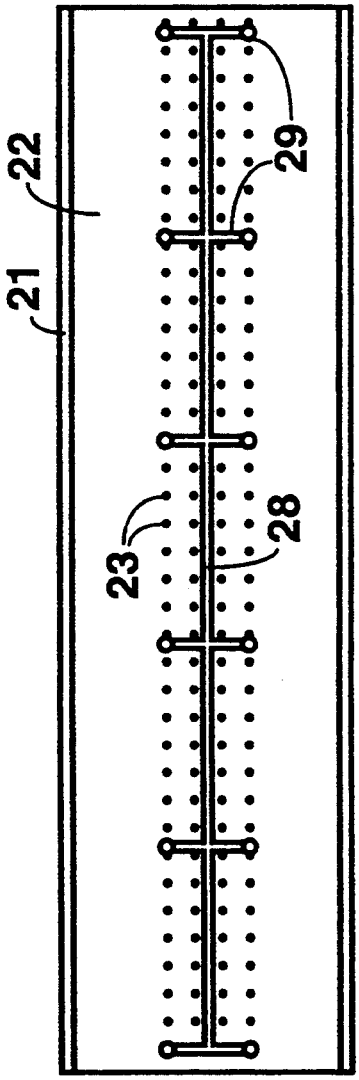
FIG. 3*a* is a schematic diagram of the back portion of the mantle showing the length-wise and cross-wise reinforcing ribs and apertures.
Figure 6:
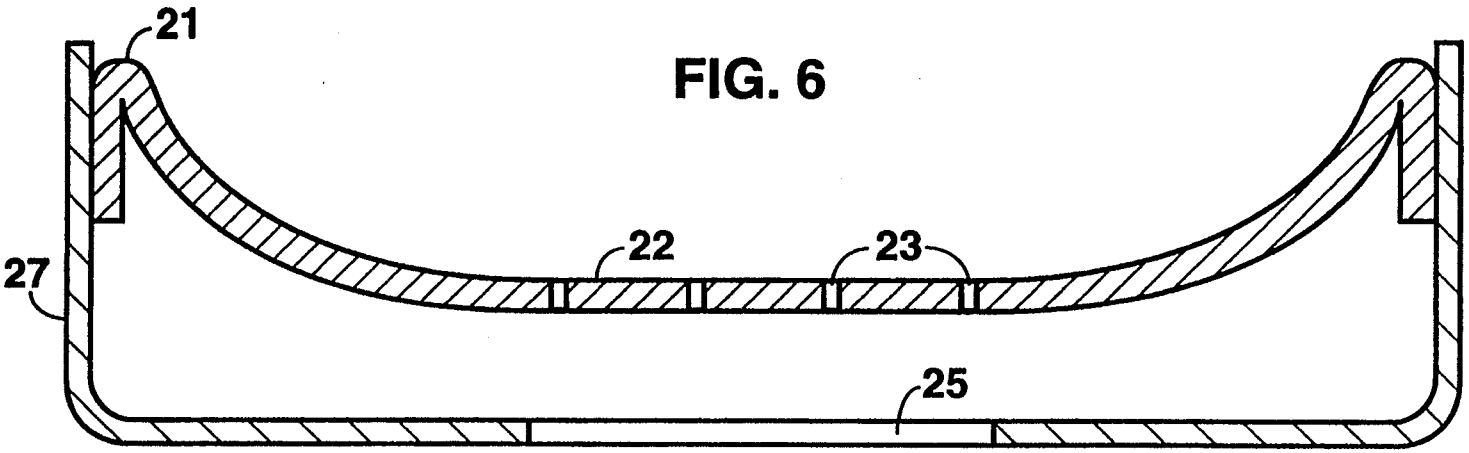
FIG. 6 is a schematic diagram of another embodiment showing a mantle which is reinforced on the bottom portion, and in which the mantle is removably supported on the base by posts.
Figure 7A:
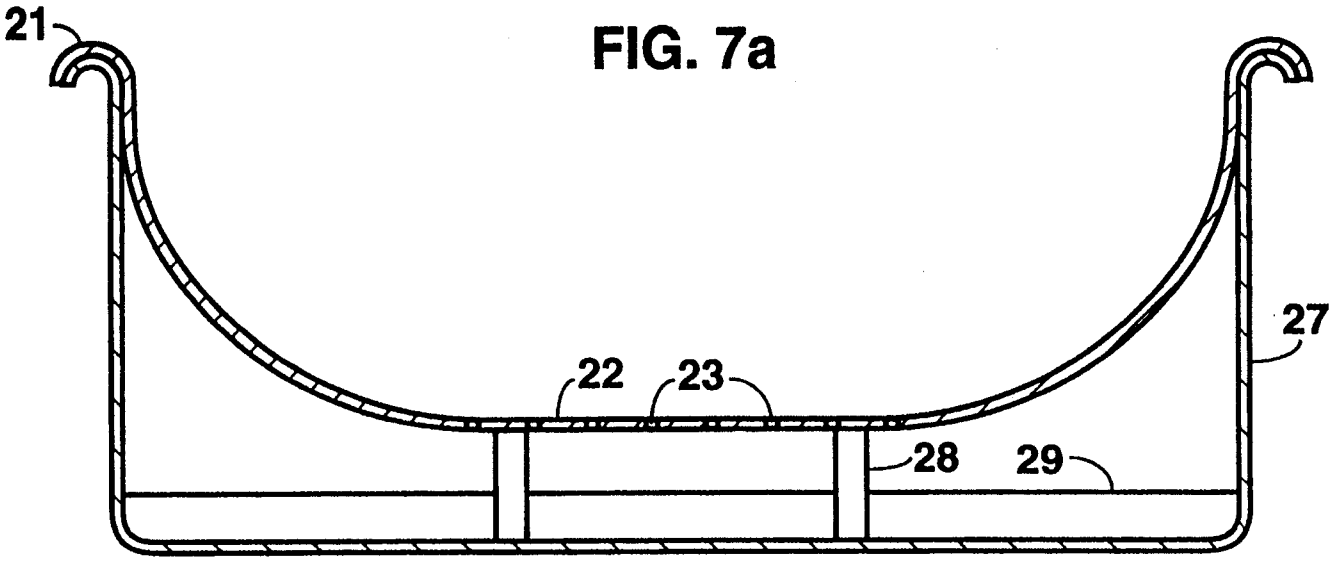
FIGS. 7*a* and 7*b* are schematic diagrams of an embodiment of the setter in which the mantle is fixedly attached to the base to form a unitary monolith.
Figure 7B:
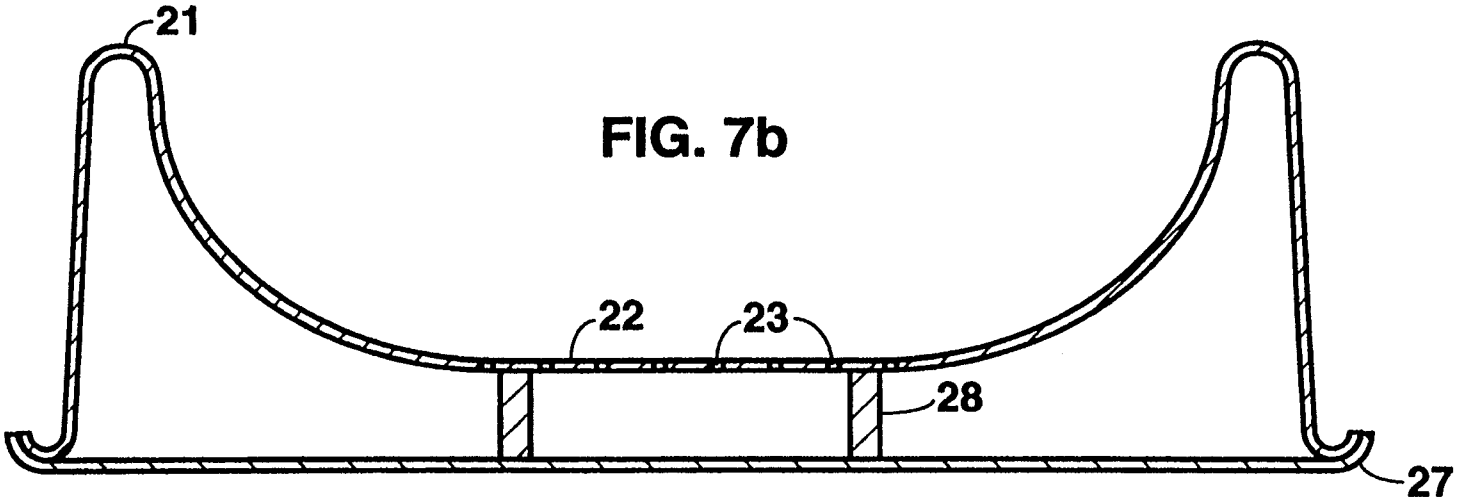
Figure 8:
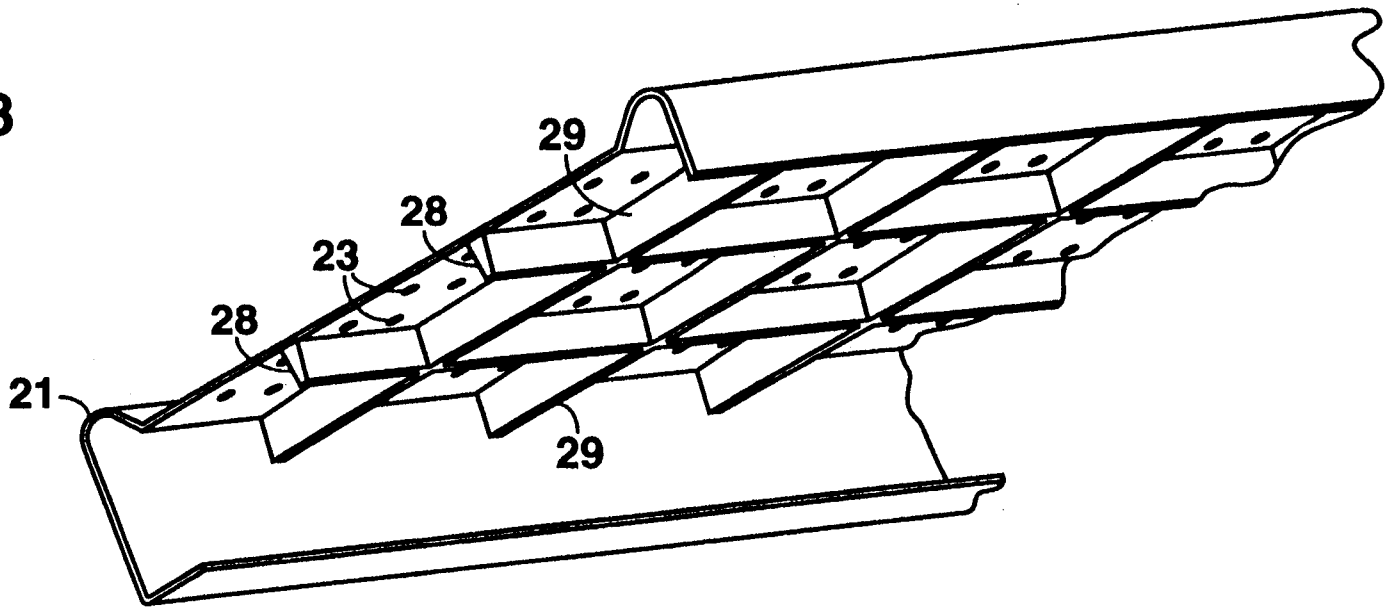
FIG. 8 is a schematic diagram showing a matrix of reinforcing length-wise and cross-wise ribs on the bottom portion of the mantle.
Figure 9:
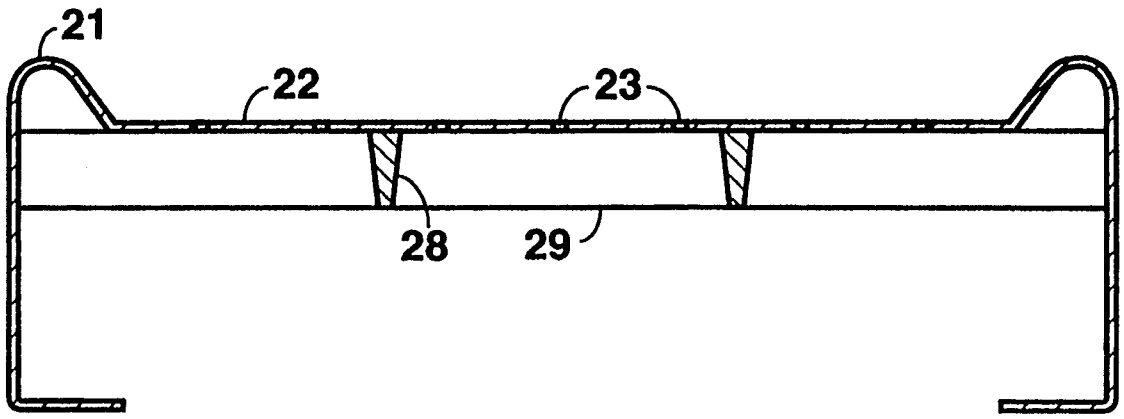
FIG. 9 is a cross-sectional view of the mantle of FIG. 8.

To provide better support of the ceramic ware 17, the bottom portion of the mantle can be reinforced with length-wise and cross-wise ribs 28 and 29 respectively as shown in FIGS. 3*a* and 8, and legs or posts as shown in FIGS. 5 to 9, to support the mantle on the base. In addition to ribs and posts, or alternatively, the mantle can be reinforced by increasing the thickness of the bottom portion of the mantle (that is, the portion of the mantle which forms the cradle) as shown in FIG. 6, to provide greater reinforcement and prevent the mantle support surface or cradle portion from sagging in the dryer.

Figure 4B:
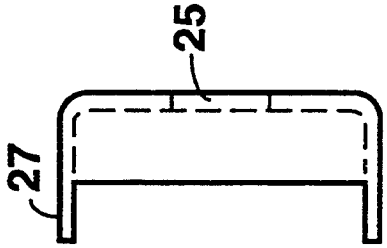
FIG. 4*b* is a side view of the base of FIG. 4*a;*
Figure 4A:
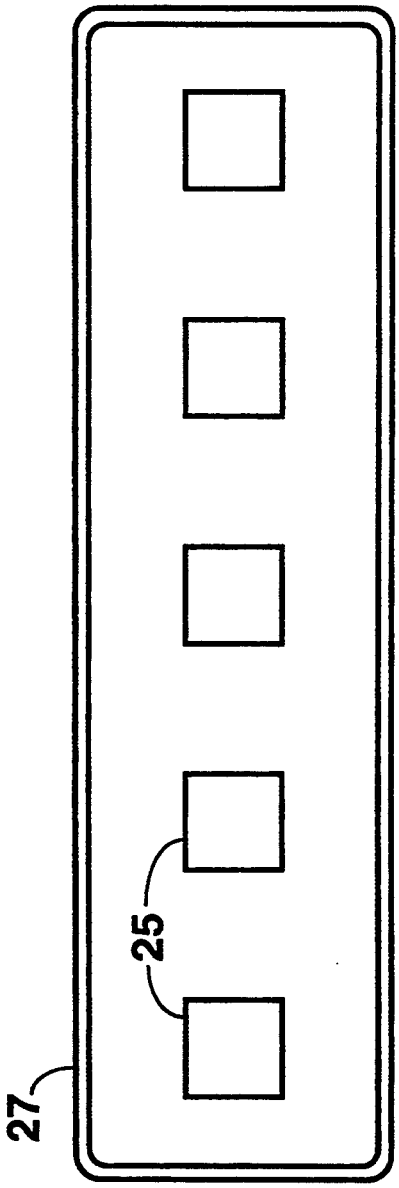
FIG. 4*a* is a schematic diagram of the base showing the holes.
Figure 5:
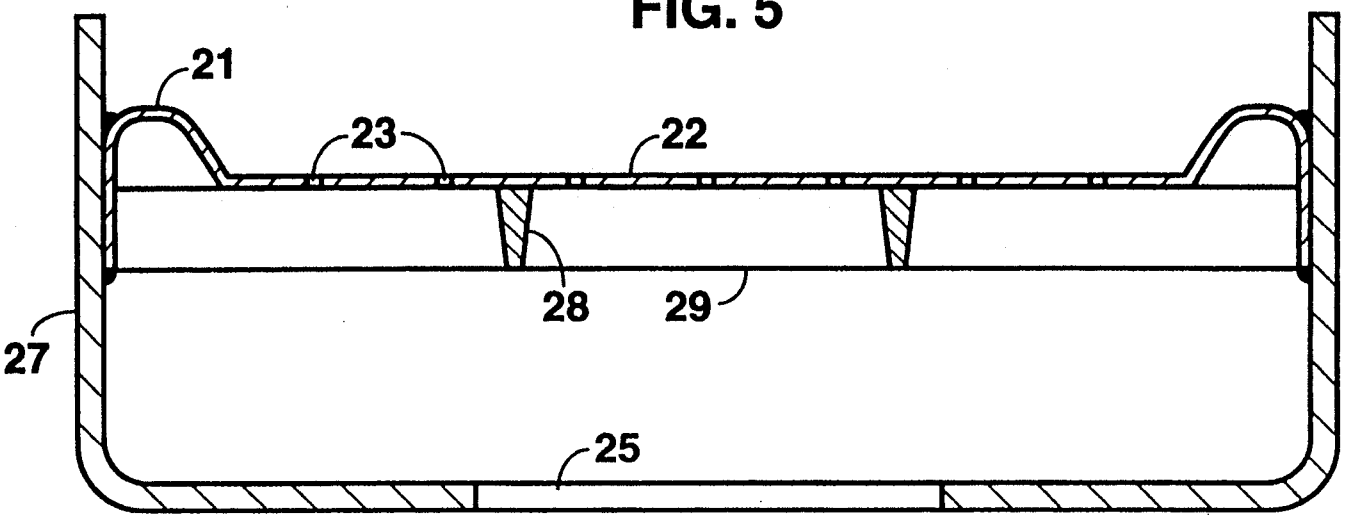
FIG. 5 is a schematic diagram of one embodiment of the setter showing a top portion or mantle having reinforced bottom portion, and being detachably connected to a base.

To ensure free air movement between the mantle or cradle and the base, as well as through the ware, the ends of the carrier or setter should be open as shown in FIG. 2. In addition, numerous small holes or apertures 23 can be provided on the support surface or cradle 22 to ensure continuous air movement through the ware and avoid formation of stagnant air and/or moisture pockets which may form and cause arcing and/or burning as described below. Large holes or openings 25 may also be provided in the base 27 as shown in FIG. 4*a*, to further improve continuous air movement in the carrier.

I have found that stagnant or trapped air volumes or localized air and/or moisture pockets tend to induce arcing and/or burning. Without intending to be bound by theory, it is believed that such arcing is caused by the ionization of the air by the energy field. To prevent arcing and burning, the cradle or support surface of the mantle or tray which is in contact with the ceramic ware should be such that no localized moisture or trapped air collects in the interface between the ware and the cradle. This can be achieved by the aforementioned numerous small holes or apertures. Air and moisture pockets can also be avoided by using an open mesh of material to form the cradle. One particularly useful design of the cradle consists of an open mesh of fiberglass (much like a tennis racket, but having smaller openings or spaces), wetted with polyester such that some, but not all the spaces between the fiberglass are filled with the polyester.

The mantle may be either fixedly or detachably connected to the base. When the mantle is fixedly connected to the base, the carrier is a monolithic structure. When the mantle is detachably connected to the base, the base is sufficiently longer and wider than the mantle so that the mantle can be set in the base. In one particularly useful embodiment, the mantle is fixedly attached to the base so as to form a monolithic carrier structure.

Referring to FIG. 2, a section of the carrier or setter 20 is illustrated comprising a mantle having a support surface or cradle 22 which is contoured to fit the surface of the ceramic ware or structure 17. The support surface 22 has a plurality of apertures 23 disposed therein, through which air is allowed to circulate or move freely through the structure.

The setter or tray of the invention is useful for drying any shape and size of cellular ceramic structures. In particular, the setter is useful for drying very large frontal area (VLFA) structures such as used for diesel particulate filters, as well as large frontal area (LFA) diesel flow-through substrates. The cradle of the setter can be contoured to fit the particular cross-section of the structure. Thus, the cradle can be contoured to a square cross-section as in FIG.5, oval or racetrack cross-section as in FIGS. 6–7*b*, circular as in FIG. 2, or any desired cross-section.

To use the apparatus of the invention, after forming a wet ceramic structure, the structure is supported on a setter which is supported on a base, and conveyed into and through an electromagnetic energy field for drying and firing. The setter is characterized by a top portion or mantle having a support surface or cradle, and a bottom portion or base. The cradle is contoured to fit the shape of the ceramic structure and includes a plurality of apertures to allow free air movement and prevent stagnant air volumes. The base is connected to the mantle and also includes a plurality of large apertures or openings, and open ends to allow free air movement between the mantle and the base. The setter is further characterized by low absorption of energy in the radio frequency range. To avoid the creation of stagnant air volumes which may lead to arcing, continuous air movement may be created, for example, by blowing air through the energy field.

The setter design of the invention provides several advantages over ceramic setters. For example, like ceramic setters, the reinforced setters of the invention are resistant to high temperatures; but the setters of the invention are more durable and therefore, less likely to produce irritating dusts during use. Because the present setters absorb very little or no energy in the radio frequency range, higher drying rates are achieved as most of the energy is directed to drying the object to be dried. In addition, the setters are lighter, easier to handle, and more resistant to damage when dropped. Even though arcing is substantially eliminated by the present methods, in the unlikely event of arcing, the setters will char rather than melt, thus avoiding difficult cleanup problems. Also, these setters are tougher and therefore more durable than ceramic setters.

To test the effectiveness of the fiberglass reinforced polyester setters, in one experiment a long cellular ceramic log having 400 cells per square inch (cpsi) (64 cells per square centimeter (cpscm)), and having a racetrack cross section of 6 inches by 9 inches, was cut into five samples measuring 22 inches in length, and four samples measuring 12 inches in length. The samples were loaded onto fiberglass setters or trays with the shorter logs being set end-to-end to stimulate long logs, and loaded behind the five longer logs. The dryer was set at full power, 18 RFKV, 24 belt speed and 11-inch electrode plate height. After the middle samples were completely dry (i.e., less than 1% of the original water content remaining), no burning, charring, arcing or smoking was observed. The cross-section of the dried samples was about 5 inches by 8 inches.

In another experiment four setters were made by inserting fiberglass reinforced polyester mantles in four Lexan® base portions. A fifth setter was made by forming a unitary monolith comprising a ceramic mantle or top portion which is fixedly connected to a Lexan® base. The five setters were used to test the thermal and mechanical stability of fiberglass/polyester setters in high frequency energy environments. To be acceptable, the trays should cycle through a high frequency environment for 8 to 16 hours without charring, arcing, distortion, breakage or other forms of damage.

After 14 hours of continuous cycling in a dielectric dryer, no charring, arcing, distortions or other damages were observed. In addition to the embodiments discussed above, it should be understood that given the teachings herein, numerous alternatives and equivalents which do not depart from the present invention will be apparent to those skilled in the art, and are intended to be included within the scope of the present invention. It should also be understood that this invention is not to be unduly limited to the illustrative embodiments set forth herein.

I claim:

1. Apparatus for drying ceramic structures in an electromagnetic energy field, comprising:

a setter for supporting a wet ceramic structure in an electromagnetic energy field, the setter being capable of absorbing no more than 10% of electromagnetic energy in the range of 10 MHz to 3.0 GHz, comprising a mantle forming a top portion, the mantle having a support surface forming a cradle, and a base forming a bottom portion, the cradle being contoured to fit the shape of the ceramic structure and comprising a plurality of apertures, the base being connected to the mantle and having a plurality of large apertures or openings, and open ends to allow free air movement between the mantle and the base;

means for generating an electromagnetic energy field; and conveying means for moving the ceramic structure through the energy field.

2. The apparatus of claim 1, wherein the mantle further comprises reinforcing ribs or posts for supporting the mantle on the base.

3. The apparatus of claim 1, wherein the cradle comprises fiberglass, polyester and mixtures thereof.

4. The apparatus of claim 1, wherein the base is essentially flat.

5. The apparatus of claim 1, wherein the mantle comprises an open mesh.

6. The apparatus of claim 1, wherein the electromagnetic energy is in the frequency range of between about 10 MHz and 3.0 GHz.

7. The apparatus of claim 6, wherein the setter absorbs less than 10% of the electromagnetic energy.

8. A method of drying ceramic structures in an electromagnetic energy field, comprising:

forming a wet ceramic structure;

supporting the wet ceramic structure on a setter comprising a mantle forming a top portion, the mantle having a support surface forming a cradle, and a base forming a bottom portion, the cradle being contoured to fit the shape of the ceramic structure and comprising a plurality of apertures, the base being connected to the mantle and having a plurality of large apertures or openings, and open ends to allow free air movement between the mantle and the base; and conveying the wet ceramic structure into and through an electromagnetic energy field in the range of 10 MHz to 3.0 GHz to dry the structure;

the setter being characterized by being capable of absorbing no more than 10% of electromagnetic energy in the range of 10 MHz to 3.0 GHz.

9. The method of claim 8, wherein the electromagnetic energy is in the frequency range of between about 10 MHz and 3.0 GHz.

10. The method of claim 9, wherein the setter absorbs less than the 10% of the electromagnetic energy.

11. The method of claim 8, wherein the wet ceramic structure is conveyed through the energy field for a time sufficient to reduce the water content to less than 1% of its original level.

12. The method of claim 8, further comprising the step of creating continuous air movement through the energy field.

13. Setter for supporting a wet ceramic structure in an electromagnetic energy field, comprising: (1) a mantle forming a top portion, the mantle having a support surface forming a cradle having a plurality of apertures and being contoured to fit the shape of the ceramic structure, and (2) a base having a plurality of openings connected to the mantle and forming a bottom portion, the setter being characterized by being capable of absorbing no more than 10% of electromagnetic energy in the range of 10 MHz to 3.0 GHz.

14. The setter of claim 13, comprising fiberglass, polyester, and mixtures of these.

15. The setter of claim 14, comprising fiberglass reinforced polyester.

16. The setter of claim 14, wherein the cradle comprises an open mesh of fiberglass.

17. The setter of claim 16, wherein some of the open meshes are filled with polyester.

* * * * *